United States Patent [19]

Conover

[11] 4,456,399

[45] Jun. 26, 1984

[54] APPARATUS FOR LAYING PAVING FABRIC

[76] Inventor: Richard A. Conover, P.O. Box 1497, Bartsville, Okla. 74003

[21] Appl. No.: 118,581

[22] Filed: Feb. 4, 1980

[51] Int. Cl.[3] ..... E01C 3/00; E01C 11/16

[52] U.S. Cl. ..... 404/100; 404/83

[58] Field of Search ..... 404/100, 83; 242/86.52, 242/76, 68, 68.5, 75.2; 226/17; 15/117

[56] References Cited

U.S. PATENT DOCUMENTS

| | | | |
|---|---|---|---|
| 96,219 | 10/1869 | Gibson | 15/111 X |
| 600,222 | 3/1898 | Hasson | 15/111 X |
| 2,170,578 | 8/1939 | Sperry | 226/17 X |
| 2,486,121 | 10/1949 | Corn | 226/199 X |
| 3,146,964 | 9/1964 | Schultz et al. | 242/68.3 |
| 3,175,256 | 3/1965 | Horton | 15/117 X |
| 3,332,124 | 7/1967 | Beard | 242/76 X |
| 3,374,964 | 3/1968 | Carvotta | 242/86.52 |
| 3,604,324 | 9/1971 | Middlestadt | 404/83 |
| 3,619,845 | 11/1971 | Partridge et al. | 15/117 |
| 3,913,854 | 10/1975 | McClure | 242/86.52 X |

FOREIGN PATENT DOCUMENTS

| | | | |
|---|---|---|---|
| 1123755 | 8/1968 | United Kingdom | 404/83 |

OTHER PUBLICATIONS

"Petromat" Advertisement, Phillips Fibers Corporation, *Civil Engineering–ASCE*, 2/77.

*Primary Examiner*—Rodney H. Bonck

[57] ABSTRACT

An apparatus for facilitating the laying of paving fabric along a road bed, or the like, and comprising a core support member of an adjustable length for supporting a roll of the paving fabric on a vehicle whereby the web of fabric may be pulled from the supply roll for application to the surface of the road bed, a tension applying apparatus secured in the proximity of the fabric roll for receiving the web thereover in order to remove wrinkles from the web prior to the application of the web to the surface of the road bed, and a broom apparatus secured in the proximity of the location of the engagement of the web with the road bed for facilitating adherance of the web thereto, and a guard for the broom for precluding wrinkling of the fabric at the broom location.

12 Claims, 10 Drawing Figures

APPARATUS FOR LAYING PAVING FABRIC

BACKGROUND OF THE INVENTION

1. Field of the Invention

This invention relates to improvements in the paving of a road bed and more particularly, but not by way of limitation, to apparatus for facilitating the laying of paving fabric along the surface of a road bed or the like.

2. Description of the Prior Art

In the road paving industry, it is common practice today to move a vehicle along the length of the road bed for the initial laying of a suitable paving fabric along the surface of the ground. These vehicles are usually provided with a large roll of paving fabric carried at the forward end thereof, and the outer end of the fabric web wound on the roll is initially brought into engagement with the surface of the road bed, and the vehicles moves forwardly along the road bed and over the edge or end of the paving fabric whereby web is unreeled from the supply roll and laid over the surface of the road bed. The wheels of the vehicle not only pull the fabric from the roll, but also move over the web being laid for facilitating the adhering of the web to the road bed. One of the most difficult problems in the laying of these paving fabrics is the accumulation of wrinkles in the fabric as it is pulled from the supply roll as it is actually laid along the surface of the road bed. In order to alleviate this situation, it is a common practice to provide a transversely extending broom means, or the like, disposed substantially at the point of engagement of the fabric web with the surface of the road in order to apply pressure against the web during the application thereof, and to wipe out or sweep away any wrinkles which may form. This is largely unsatisfactory, however, and any wrinkles which occur in the laid fabric are a detriment to the overall paving operation.

SUMMARY OF THE INVENTION

The present invention contemplates a novel apparatus for laying paving fabric which has been particularly designed and constructed for overcoming the foregoing disadvantages. The novel apparatus comprises a telescopic core support rod for securing the fabric supply roll to the vehicle, thus facilitating the use of substantially any desired fabric width with a single vehicle. Web spreader means is secured in the proximity of the supply roll for receiving the web thereover prior to application thereof to the surface of the road bed, said web spreader means being adapted for applying lateral or transverse tension across the travelling web in order to smooth out substantially all wrinkles which may appear or accumulate in the web being pulled from the supply roll and for precluding the forming of additional wrinkles during the laying operation, thus greatly enhancing the laying of a smooth, substantially wrinkle free paving fabric along the surface of the road bed. In addition, the usually tranversely extending brush is provided with a brush guard which engages the fabric as it is being placed against the surface of the road bed, and substantially precludes any "working up" of the fabric between the fibers of the broom for further reducing wrinkles in the laid fabric, and also substantially precludes curling of the edges of the fabric. The novel apparatus is simple and efficient in operation and economical and durable in construction.

DESCRIPTION OF THE PREFERRED EMBODIMENTS

Figure 1:
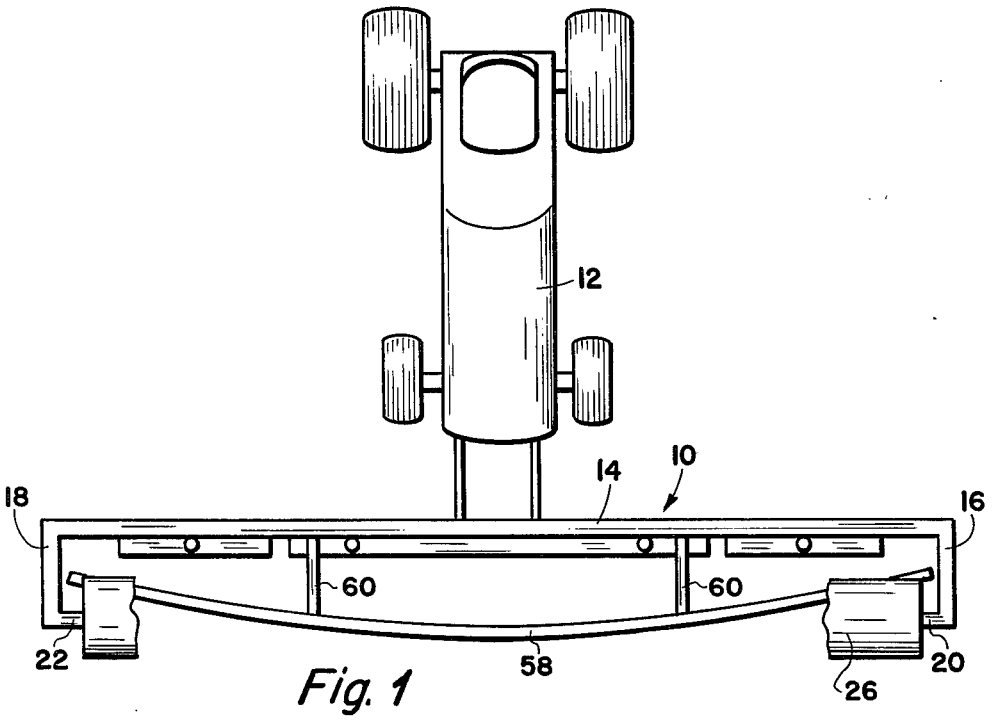
FIG. 1 is a plan view of a paving fabric laying apparatus embodying the invention, with portions cut away and eliminated for purposes of illustration.

Referring to the drawings in detail, and particularly FIGS. 1 through 6, reference numeral 10 generally indicates paving fabric apparatus adapted to be secured to a suitable vehicle 12, and comprising a transversely extending bar 14 having outwardly extending arms 16 and 18 provided at the opposite ends thereof. Each of the arms 16 and 18 is provided with inwardly directed connector members 20 and 22 which are disposed in substantial axial alignment for supporting a telescopic support rod assembly 24 therebetween. The support rod assembly 24 may be inserted longitudinally through the central core of a suitable fabric supply roll 26 for supporting the roll 26 in a substantially horizontal position with respect to a road bed 28 and in vertically spaced relation with respect thereto, as will be hereinafter set forth, in detail.

The support rod assembly 24 comprises a tube member or outer housing 30 having the opposite ends thereof open for slidably receiving a first rod member 32 through one end thereof and a second rod member 34 through the opposite end thereof. A stop member 36 is secured within the tube 30 in any suitable manner such as a plurality of circumferentially spaced pins or set screws 38, and is interposed between the inner ends of the rods 32 and 34 as particularly shown in FIG. 5. A suitable helical spring 40 is disposed within the tube 30 between the stop member 36 and the rod 32 for constantly urging the rod 32 in a right hand direction as viewed in FIG. 5. The outer end of the rod 32 terminates in a head member 42 which is engaged by one of the connector members, such as the connector member 20 in any suitable or well known manner. The rod 34 is freely slidable within the tube 30 and the position thereof may be selected as desired in accordance with the length of the central core (not shown) of the fabric supply roll 26. Of course, the stop member 36 limits the depth of insertion of the rod 34 within the tube 30. When the desired position of the rod 34 has been selected, the rod 34 may be securely retained in the selected position by a plurality of set screws 44, or the like, as is well known.

The outer end of the tube 34 is provided with a plurality of circumferentially spaced radially outwardly extending fins 46 having the outer edges thereof defining a circle substantially equal to the inner circumference of the core of the roll 26, and the outer end of the tube 34 is also preferably pointed as shown at 48 for engagement with the other connector member, such as the connector 22, whereby the support rod assembly 24 may be supported in a substantially horizontal position above the surface of the road bed 28. In addition, a pair of guide members 50 and 52 are secured in spaced relation along the outer periphery of the rod 30, and each guide member 50 and 52 comprises a plurality of circumferentially spaced longitudinally extending fin members 54 having the outer edges thereof defining a circle substantially equal to the inner circumference of the core of the fabric roll 26. When the assembly 24 is inserted through the core member, the fins 54 and 46 are of a slip fit therein, thus providing an efficient support for the supply roll during a fabric laying operation on the road bed 28, as will be hereinafter set forth.

It will be readily apparent that the telescopic arrangement of the rods 32 and 34 with respect to the tube or housing 30 provides for a substantially infinitely variable overall length for the support rod assembly 24, thus eliminating the need for support rods of varying lengths normally required for paving fabrics of differing widths.

Figure 2:
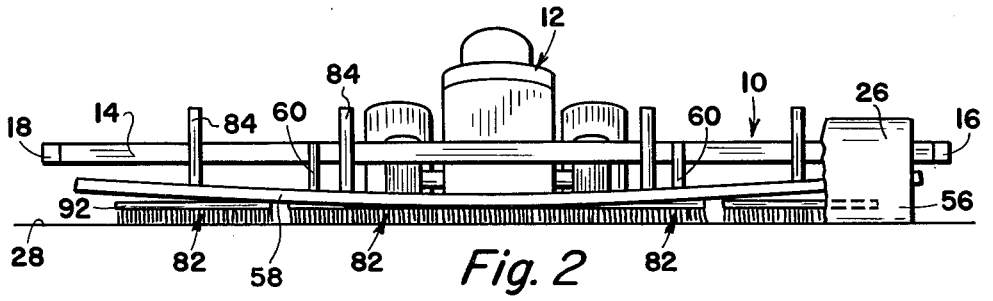
FIG. 2 is a front elevational view of a paving fabric laying apparatus embodying the invention.
Figure 3:
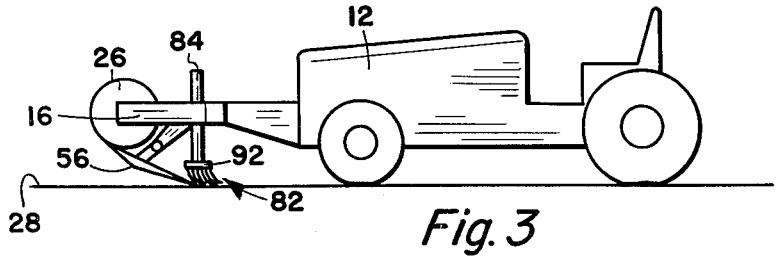
FIG. 3 is a side elevational view of a paving fabric laying apparatus embodying the invention.
Figure 5:
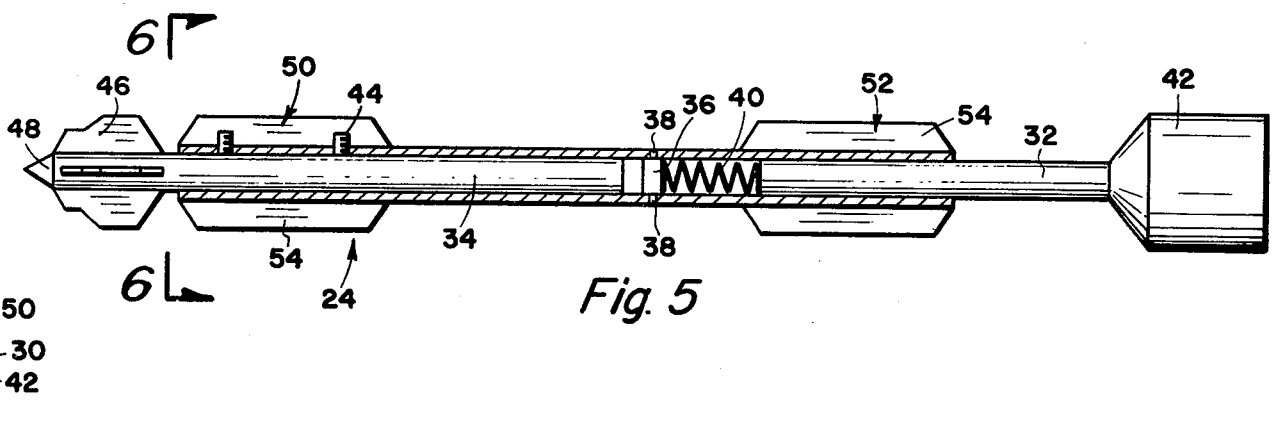
FIG. 5 is a sectional elevational view of the support rod shown in FIG. 4, and illustrated in a contracted position.
Figure 6:
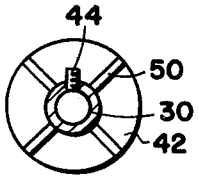
FIG. 6 is a view taken on line 6—6 of FIG. 5.
Figure 4:
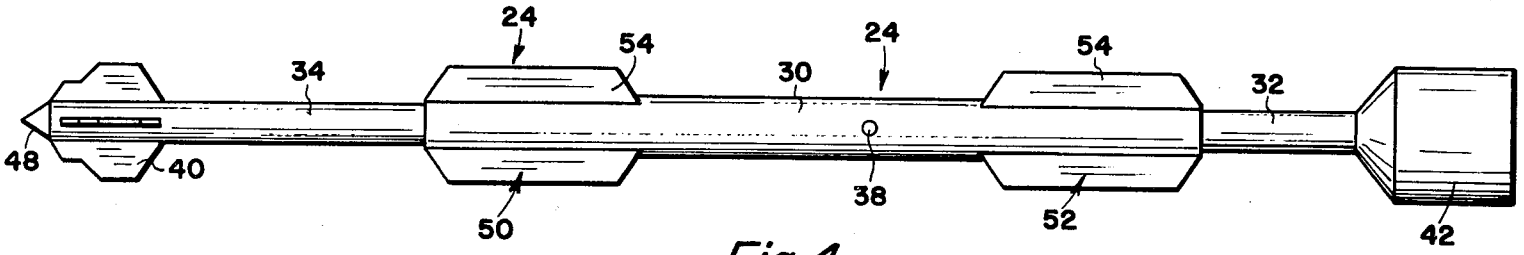
FIG. 4 is a side elevational view of a support rod utilized in a paving fabric laying apparatus embodying the invention, and illustrated in an extended position.

During the laying of the paving fabric, the fabric is pulled from the supply roll for engagement with the road bed 28 as shown at 56 in FIG. 2. A bow bar 58 is secured to the bar 14 by a plurality of spaced bracket members 60 and extends therefrom in a direction toward the roll 26. The bow bar 48 is of an arcuate configuration in at least two direction as will be apparent from an inspection of FIGS. 1 and 2 whereby the bar is non-planar, and the outer periphery of the bar 58 receives the fabric 56 thereacross at a point between the supply roll 26 and the road bed 28. The engagement of the bow bar 58 with the fabric 56 provides a tension across the width of the fabric and stretches the fabric in a transverse direction for removing any wrinkles from the fabric and preventing the formation of any additional wrinkles. In this manner the fabric being laid on the road bed 28 is substantially wrinkle free, which produces a greatly improved end product.

Figure 7:
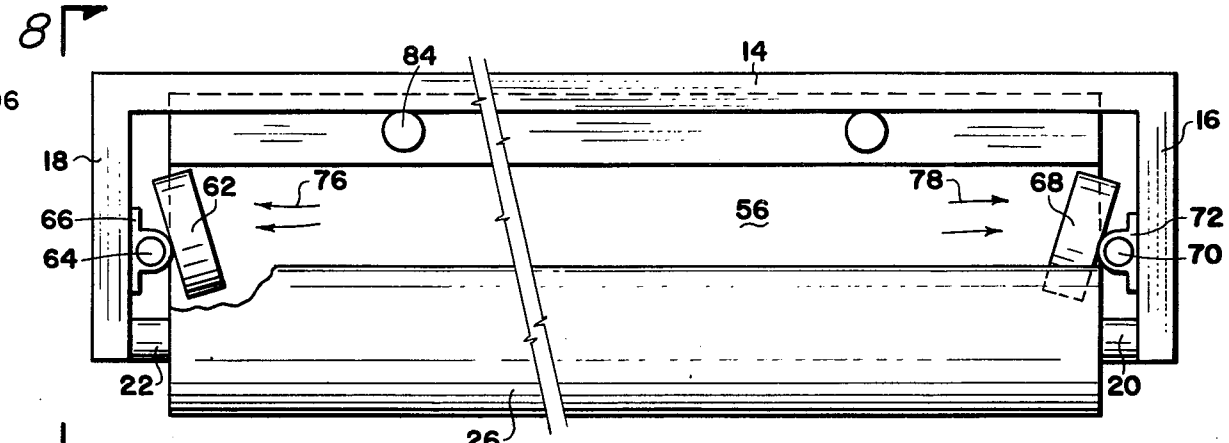
FIG. 7 is a plan view of a modified paving fabric laying apparatus embodying the invention.
Figure 8:
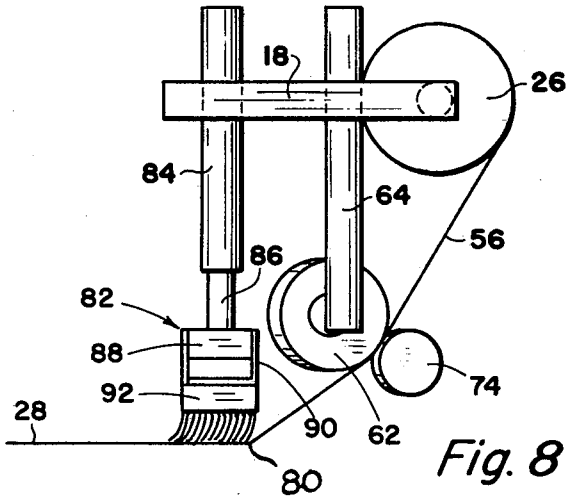
FIG. 8 is a view taken on line 8—8 of FIG. 7.
Figure 10:
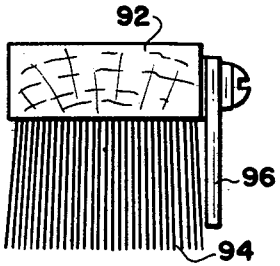
FIG. 10 is a view taken on line 10—10 of FIG. 9.
Figure 9:
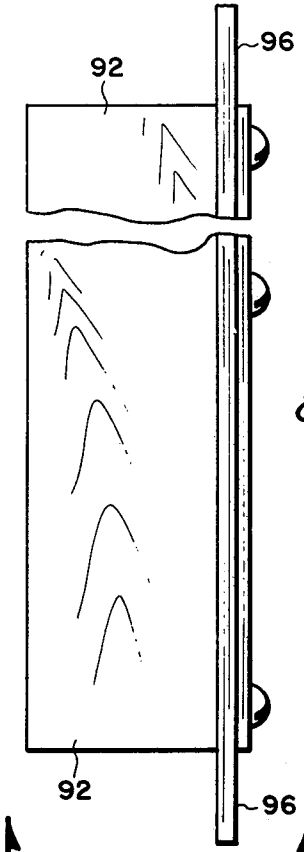
FIG. 9 is a side elevational view of a brush guard utilized in a paving fabric laying apparatus embodying the invention.

An alternate means for applying transverse tension to the fabric 56 is shown in FIGS. 7 and 8. A first tension wheel 62 is suitably journalled on an arm 64 which, in turn, is secured to the arm 18 by a suitable bracket 66, and extends downwardly therefrom as shown in FIG. 8. The plane of the wheel 62 is canted, or at an angle with respect to the longitudinal axis of the roll 26, and the outer periphery of the wheel 62 engages the fabric 56 in the proximity of one edge thereof between the roll 26 and the road bed 28. A second tension wheel 68 is similarly journalled on an arm 70 which, in turn, is secured to the arm 16 by a suitable bracket 72. The plane of the wheel 68 is also canted with respect to the axis of the roll 26, and preferably substantially equal and opposite with respect to the wheel 62. The wheel 68 engages the fabric 56 in the proximity of the opposite edge thereof with respect to the wheel 62, and between the roll 26 and the road bed 28. Of course, it may be desirable to provide a suitable back-up roller 74 for each wheel 62 and 69, for assuring an efficient engagement of the fabric 56 with the wheels, as is well known.

The wheels 62 and 68 cooperate to produce a transverse tension in the fabric 56 in the direction indicated by the arrows 76 and 78, respectively, and to remove substantially any wrinkles which may be present in the fabric, and prevent the formation of additional wrinkles, thus providing a substantially wrinkle free paving fabric on the road bed 28.

Substantially at the point of contact of the paving fabric 56 with the road bed 28 (as shown at 80 in FIG. 8) a plurality of brush assemblies generally indicated at 82 engage the upper surface of the laid fabric for assuring an efficient bonding of the fabric or laying of the fabric on the road bed. The brush assemblies 82 are substantially identical, and are disposed in spaced alignment across substantially the entire length of the bar 14, or length of the fabric supply roll 26 as particularly shown in FIG. 2. Each assembly 82 comprises an upright support sleeve 84 secured to the inner edge of the bar 14 in any well known or suitable manner (not shown), for receiving a reciprocal rod member 86 therein. Suitable yeildable means, such as a helical spring (not shown) may be anchored within the sleeve 84 for constantly urging the rod member 86 in an axial outward direction for a purpose as will be hereinafter set forth. A plate member 88 is secured to the outer end of the rod 86 in any well known manner for receiving and supporting a channel member 90, or the like, having an elongated brush member 92 secured thereto. The brush member 92 includes outwardly extending bristles 94 so arranged whereby the outer tips of the bristles wipe over or against the upper surface of the laid fabric for pushing the fabric smoothly against the surface of the road bed 28 during a paving fabric laying operation. A guard member 96 is removably secured along one edge of the brush member 92 and extends substantially throughout the length thereof, either at the leading or trailing edge of the bristles 94, as desired. The guard 96 is constructed of a suitable yieldable material, such as rubber, cloth power belting, or the like, and which is sufficiently stiff for preventing fabric wrinkling, yet flexible enough to deflect when striking some obstruction during a paving fabric laying operation. The guard 96 is particularly advantageous in preventing the paving fabric 56 from working up between the fibers or bristles 94 of the broom 92 thus preventing the forming of wrinkles between the bristles. When the guard 96 extends to the edge of the fabric 56, it is also of advantage in preventing the fabric 56 from curling along the edges thereof during the paving fabric laying operation.

In a paving fabric laying operation, the supply roll 26 is secured to the apparatus 10 by inserting the support rod assembly 24 through the core (not shown) of the roll 26. As hereinafter set forth, the fins 46 and 54 engage the inner periphery of the core for efficiently supporting the supply roll on the apparatus 10, and the overall length of the support rod 24 is adjustable in accordance with the longitudinal dimension of the roll 26, or in accordance with the width of the fabric 56. The fabric 56 is initially pulled from the supply roll 26 and the leading edge portions thereof are disposed on the surface of the road bed 28. The vehicle 12 is then driven forwardly, or in the direction of the roll 26, and the fabric 56 is pulled from the supply roll onto the surface of the road bed during the forward movement of the vehicle, as is well known. The bow bar 58, or tension wheels 62 and 68, or both, engage the fabric 56 between the supply roll 26 and the road bed 28 for removing substantially any preformed wrinkles from the fabric, and for substantially preventing the formation of any additional wrinkles in the fabric during the laying operation. In addition, the brush assemblies 82 sweep or wipe the upper surface of the fabric 56 as it is laid on the surface 28 for assuring an efficient placement of the fabric 56 on the road bed.

Whereas the present invention has been described in particular relation to the drawings attached hereto, it should be understood that other and further modifications, apart from those shown or suggested herein may be made within the spirit and scope of this invention.

What is claimed is:

1. In combination with a vehicle, apparatus for laying paving fabric along a road bed and comprising frame means, support means secured to the frame means for supporting and extending longitudinally through a roll of the paving fabric on the vehicle whereby the web of paving fabric may be pulled from the supply roll for application to the surface of the road bed, transverse tension applying means carried by the frame means and engageable with the web of paving fabric in the proximity of and slightly spaced from the outer periphery of the roll for removal of substantially all preformed wrinkles in the fabric as the fabric is pulled from the roll and substantially precluding the formation of additional wrinkles in the fabric during the laying operation, brush means carried by the frame means and oppositely disposed from the tension applying means with respect to the roll for engaging the surface of the paving fabric being placed on the surface of the road bed for assuring an efficient engagement of the paving fabric therewith, the roll support means comprising telescopically arranged rod members providing an adjustable overall length for the roll support means, and including sleeve means having the opposite ends thereof open for slidably receiving a telescopic rod member in each end, yieldable means disposed within the sleeve means and engagable with one of said rod members for constantly urging said one rod member in an axially outward direction, and stop means extending through said sleeve means and engagable with the other of said rod members for securely retaining said other rod member in a preselected position within the sleeve means.

2. In combination with a vehicle, apparatus for laying paving fabric along a road bed as set forth in claim 1 and including second stop means provided within said sleeve means and interposed between said rod members for limiting the movement of at least one of said rod members in one direction.

3. In combination with a vehicle, apparatus for laying paving fabric along a road bed as set forth in claim 1 and including radially outwardly extending fin means provided on the outer periphery of the sleeve means for engagement with the inner periphery of the paving fabric supply roll for securing thereof on the roll support means.

4. In combination with a vehicle, apparatus for laying paving fabric as set forth in claim 1 wherein the transverse tension applying means comprises an arcuate rod member extending in non-coplanar relation with respect to the longitudinal axis of the roll of paving fabric and in spaced relation with respect to the said roll for receiving the fabric thereover during a paving fabric laying operation.

5. In combination with a vehicle, apparatus for laying paving fabric as set forth in claim 4 wherein the rod member is of compound arcuate configuration with respect to the road bed whereby the rod is curved in a horizontally outward direction with respect to the vehicle and in a vertically downward direction with respect to the road bed.

6. In combination with a vehicle, apparatus for laying paving fabric as set forth in claim 1 wherein the transverse tension applying means comprises roller means engageable with the opposite edges of the fabric for applying said transverse tension to the fabric during a fabric laying operation.

7. In combination with a vehicle, apparatus for laying paving fabric as set forth in claim 6 wherein the roller means comprises roller members journalled for rotation in a phase angularly disposed with respect to the direction of movement of the fabric.

8. In combination with a vehicle, apparatus for laying paving fabric as set forth in claim 6 wherein the roller means comprises a pair of spaced canted roller members engageable with the opposite edges of the fabric, the plane of one roller member being disposed at an angle with respect to the plane of the other roller member whereby the roller members cooperate for providing said transverse tension to the fabric during a fabric laying operation.

9. In combination with a vehicle, apparatus for laying paving fabric along a road bed and comprising frame means, support means secured to the frame means for supporting and extending longitudinally through a roll of the paving fabric on the vehicle whereby the web of paving fabric may be pulled from the supply roll for application to the surface of the road bed, transverse tension applying means carried by the frame means and engagable with the web of paving fabric in the proximity of and slightly spaced from the outer periphery of the roll for removal of substantially all preformed wrinkles in the fabric as the fabric is pulled from the roll and substantially precluding the formation of additional wrinkles in the fabric during the laying operation, brush means carried by the frame means and oppositely disposed from the tension applying means with respect to the roll for engaging the surface of the paving fabric being placed on the surface of the road bed for assuring an efficient engagement of the paving fabric therewith, and wherein said brush means includes guard means cooperating therewith for further precluding wrinkling of the paving fabric during a fabric laying operation.

10. In combination with a vehicle, apparatus for laying paving fabric as set forth in claim 9 wherein the guard means is constructed from a material which is sufficiently stiff for providing said further precluding of wrinkling of the paving fabric and sufficiently flexible for deflecting upon striking an obstacle during a paving fabric laying operation.

11. In combination with a vehicle, apparatus for laying paving fabric as set forth in claim 10 wherein the guard means is secured to the brush means in the proximity of the leading edge of the brush means.

12. In combination with a vehicle, apparatus for laying paving fabric as set forth in claim 10 wherein the guard means is secured to the brush means in the proximity of the trailing edge of the brush means.

* * * * *